US009702068B2

(12) United States Patent
Lonati et al.

(10) Patent No.: US 9,702,068 B2
(45) Date of Patent: Jul. 11, 2017

(54) COMMAND DEVICE FOR A KNITTING MACHINE

(71) Applicant: SANTONI S.P.A., Brescia (IT)

(72) Inventors: Tiberio Lonati, Brescia (IT); Ettore Lonati, Botticino (IT); Fausto Lonati, Brescia (IT)

(73) Assignee: SANTONI S.P.A., Brescia (IT)

( * ) Notice: Subject to any disclaimer, the term of this patent is extended or adjusted under 35 U.S.C. 154(b) by 0 days.

(21) Appl. No.: 15/035,931

(22) PCT Filed: Nov. 5, 2014

(86) PCT No.: PCT/IB2014/065828

§ 371 (c)(1),
(2) Date: May 11, 2016

(87) PCT Pub. No.: WO2015/075595

PCT Pub. Date: May 28, 2015

(65) Prior Publication Data

US 2016/0265149 A1 Sep. 15, 2016

(30) Foreign Application Priority Data

Nov. 21, 2013 (IT) ..... BS2013A0172

(51) Int. Cl.
*D04B 15/82* (2006.01)
*D04B 15/68* (2006.01)
*D04B 15/32* (2006.01)

(52) U.S. Cl.
CPC ..... *D04B 15/82* (2013.01); *D04B 15/32* (2013.01); *D04B 15/68* (2013.01)

(58) Field of Classification Search
CPC ..... D04B 15/75; D04B 15/32; D04B 15/68; D04B 15/82
See application file for complete search history.

(56) References Cited

U.S. PATENT DOCUMENTS 3,683,644 A * 8/1972 Chvala ..... D04B 15/78 66/40
4,099,390 A * 7/1978 Vinas ..... D04B 15/78 66/219
4,893,104 A 1/1990 Donini
5,222,380 A * 6/1993 Lonati ..... D04B 15/00 66/134
5,802,877 A 9/1998 Yates et al.

FOREIGN PATENT DOCUMENTS

EP 2 402 492 A1 1/2012

* cited by examiner

*Primary Examiner* — Danny Worrell
(74) *Attorney, Agent, or Firm* — Pearne & Gordon LLP

(57) ABSTRACT

A command device (1) for a knitting machine, the device comprising a body (2) of the device configured for movably housing at least an actuator, at least a command organ (5) movably mounted and associated to the body (2) and destined to interact with one or more organs of a knitting machine, for example one or more needles of the knitting machine, and/or with one or more threads infeeding into the knitting machine, and at least an actuator, movably housed at least partially in the body (2) and destined to controlledly move the command organ (5). The device (1) further comprises a support frame (10), associated to the body (2) and configured so as to increase the structural solidity of the body (2).

20 Claims, 5 Drawing Sheets

FIG.1
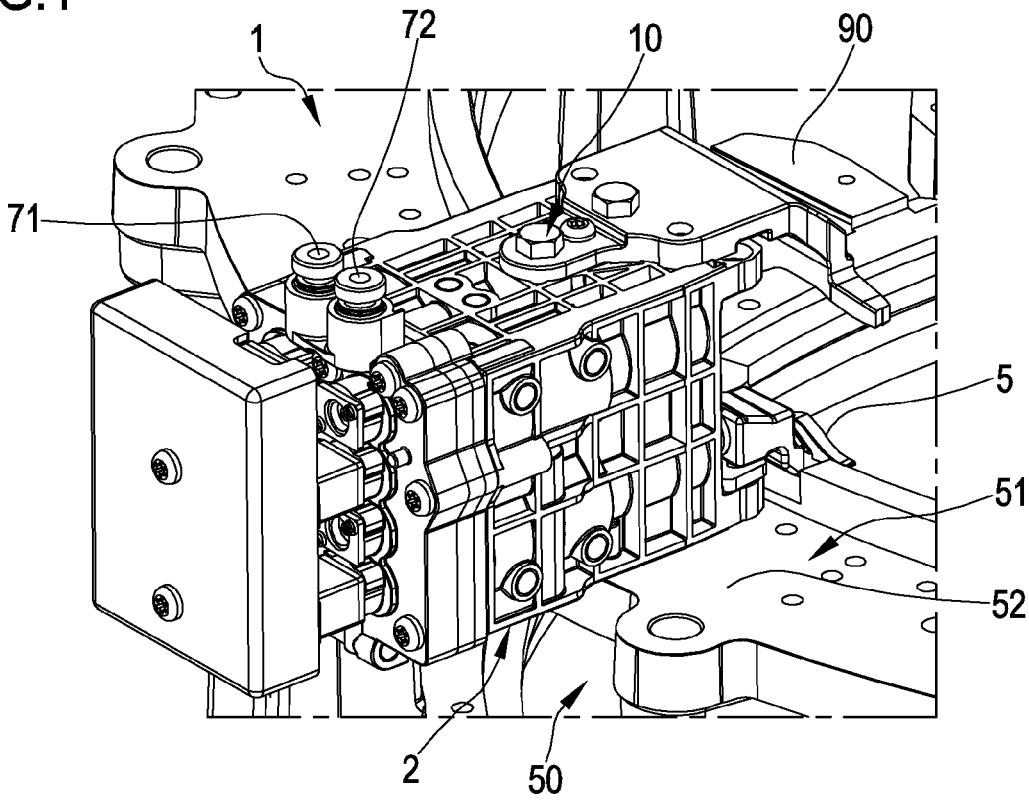
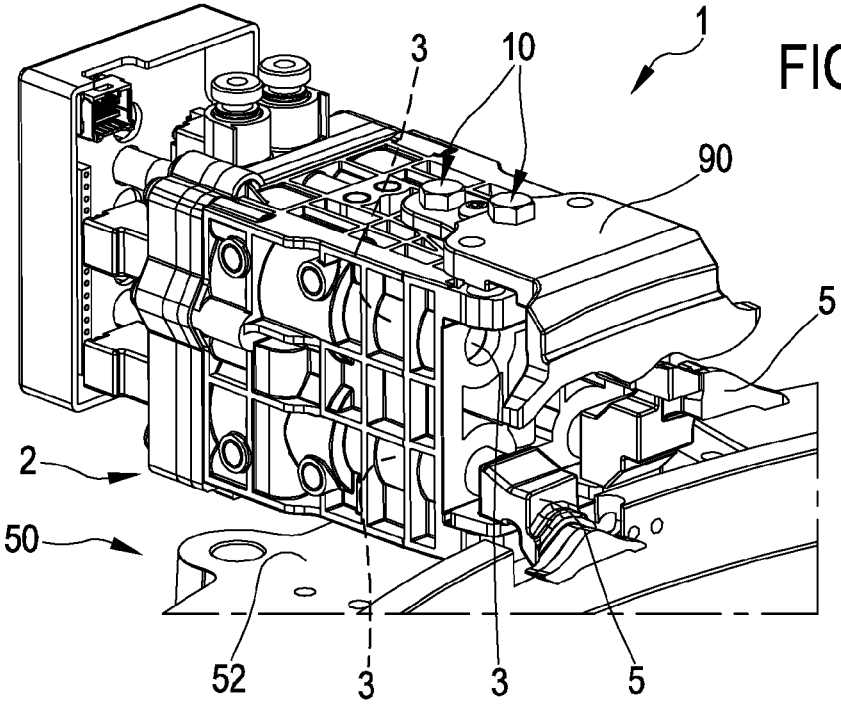
FIG.2

COMMAND DEVICE FOR A KNITTING MACHINE

The present invention relates to a command device for a knitting machine.

In greater detail, the present invention relates to the technical sector of knitting machines for knitwear, seamless knitwear, hosiery and the like, in particular circular knitting machines.

As is known, knitting machines are provided with a plurality of needles which cooperate with a set of threads for forming a knitted textile; reference is particularly made to needles of a rotating cylinder of a circular knitting machine. The knitting machines are provided with command devices able to act on the needles in such a way that they cooperate in a desired way with the threads for the formation of a stitch having determined characteristics. Other command devices cooperate with further components of the knitting head, so as to realize a determined knitting operation.

The command devices can comprise command cams (known in the sector as "needle cams") active on one or more needles of the machine such as to take them at least between a deactivated position, in which they do not interact with the threads, and an active position, in which the needles interact with one or more threads for working and forming the knitting stitch. In substance, command devices controlledly move, using appropriate actuators, the command cams so that the needles are active or not on the threads. The actuators are typically fluid-dynamic actuators, in particular pneumatic actuators or pistons, supplied with compressed air so as to translate to and fro and consequently to move the command cams nearingly and distancingly to the rotating cylinder such as to activate and deactivate the needles during the formation of the knitting.

A knitting machine typically comprises a plurality of command devices, arranged about the rotating cylinder such as to command the movement of a plurality, and preferably all, the needles of the cylinder.

Each command device typically comprises two actuators able to independently command two command cams; in this configuration the device is also known in the sector with the term "dual cam"; by flanking a determined number of dual cams it is possible to configure the thread feeders of the knitting machine.

The known devices typically comprise metal components which realise a single group housing the various elements such as cams, actuators, springs, gaskets. The known devices are therefore positioned on the bearing structure and are constrained thereto.

Also known are further command devices for knitting machines, equipped—in the place of the above-mentioned command cams—with various command organs active on the components of the knitting head or on the infeed threads. An example of a command device is the thread guide group, i.e. a device provided with a plurality of command organs known as thread guides which selectively manage the feeding of the single threads to the needles of the needle cylinder.

A further example of a command device for knitting machines is the clamps group, i.e. a device provide with a plurality of command organs known as clamps which selectively retain the single threads during the creation of the fabric.

These command devices for knitting machines have in common the presence of a body of the device, of one or more command organs, and of corresponding one or more actuators (typically pneumatic) active on the command organs.

The Applicant has found that the known command devices are not without drawbacks and can be improved in various ways, in particular with reference to the structure thereof.

A drawback typical of the known devices is determined by the structural complexity thereof, which increases the mounting times and realization costs. A further drawback is the difficulty connected with the mechanical working operations necessary for realizing the bodies of the known devices. A further drawback of the known devices is their limited structural solidity and/or their resistance to stress forces in operating conditions. A further drawback is the difficulty connected to the fixing operations of the known devices to the bearing structure of the machine. Further, the set-up of the known devices is more greatly susceptible to mounting errors. Also, the fixing of the known devices to the bearing structure of the knitting machine can lead to damage to the structure of the devices themselves. Further, the known devices are subjects to faults and/or malfunctioning.

In this situation, the aim underlying the present invention, in its various aspects and/or embodiments, is to provide a command device for a knitting machine which can obviate one or more of the cited drawbacks.

A further aim of the present invention is to disclose a command device for a knitting machine characterised by a simple and rational structure.

A further aim of the invention is to provide a command device for a knitting machine characterised by great ease of fixing to the bearing structure of a knitting machine.

A further aim of the present invention is to provide a command device for a knitting machine characterised by an easy set-up and/or maintenance.

A further aim of the present invention is to provide a command device able to reduce assembly errors.

A further aim of the present invention is to provide a command device for a knitting machine characterised by a significant duration over time and/or more resistant to faults or malfunctioning.

A further aim of the invention is to provide a command device for a knitting machine characterised by modest realisation costs with respect to the performance and quality offered. These aims and others besides, which will better emerge during the course of the following description, are substantially attained by a command device for a knitting machine according to one or more of the appended claims, each of which can be taken alone (without the relative dependencies) or in any combination with the other claims, as well as the following aspects and/or embodiments, variously combined, also with the above-mentioned claims.

In a first aspect, the invention relates to a command device for a knitting machine, the device comprising:

- a body of the device configured so as to movably house at least an actuator;
- at least a command organ movably mounted and associated to the body and destined to interact with one or more organs of a knitting machine, for example one or more needles of the knitting machine, and/or with one or more threads infeeding into the knitting machine;
- at least an actuator, movably housed at least partially in the body and destined to controlledly move the command organ.

In an aspect the device comprises a support frame, associated to the body.

In an aspect the support frame is configured for increasing the structural solidity of the body.

In an aspect, the support frame is configured for mounting the body, according to a determined mounting configuration, to a bearing structure of the knitting machine, the determined mounting configuration of the knitting machine comprising at least a mounted position of the body with respect to the bearing structure of the knitting machine.

In an aspect the support frame is distinct from the body of the device.

In an aspect the determined mounting configuration is characterised by a predetermined and/or substantially constant blocking force, defined by the support frame on the body in a mounting configuration of the device to the bearing structure of the knitting machine.

In an aspect the blocking force is such as to prevent a compression and/or deformation of the body during the mounting of the device to the bearing structure of the knitting machine. In aspect the body of the device is one and one only for the whole device. In an aspect the body of the device is realized in a single piece.

In an aspect the body of the device and the frame are made of different materials. In an aspect the body is entirely realised in a single material, and the frame is entirely made of a single respective material. In an aspect the body is made of a plastic material, preferably a polymer material and/or a plastic material comprising a percentage of carbon preferably of at least 10% in weight and/or 20% in weight and/or 30% in weight. In an aspect the frame is made of a metal material, preferably steel, iron, aluminium or alloys thereof.

In an aspect the device is destined to be mounted to a fixed ring of the bearing structure of a circular knitting machine, the fixed ring developing circumferentially about the needle cylinder of the circular knitting machine.

In an aspect the frame at least partially crosses the body of the device, reaching, in the mounting configuration, the bearing structure of the knitting machine.

In an aspect the body of the device exhibits an upper surface and a lower surface. In an aspect the lower surface of the body is destined to rest on a rest surface of the fixed ring of the bearing structure of the knitting machine.

In an aspect the body of the device comprises at least a first hole passing through the upper surface and the lower surface and crossing an internal portion of the body, and the frame comprises at least a first column, insertable in the first hole, and first fixing means configured so as to join the first column to the body and so as to mount the body—first column assembly to the fixed ring of the bearing structure of the knitting machine.

In an aspect the first hole extends vertically between the upper surface and the lower surface and/or is perpendicular to the upper surface and the lower surface. In an aspect the first hole has a circular section, preferably constant. In an aspect the first column is substantially complementarily-shaped to the first hole.

In an aspect the first column extends longitudinally between an upper end, positioned in proximity of the upper surface of the body, and a lower end, opposite the upper end and positioned in proximity of the lower surface of the body.

In an aspect the first fixing means comprise a first thread, realized on the upper end of the first column, and a second thread realised on the lower end of the first column.

In an aspect the first fixing means comprise a first screw and a second screw, the first screw being configured for coupling with the first thread and the second screw being configured for coupling with the second thread.

In an aspect the upper end and the lower end of the first column each define a respective rest surface perpendicular to the longitudinal development of the first column, the first thread extending on the first column starting from the rest surface of the upper end, and the second thread extending on the first column starting from the rest surface of the lower end and in an opposite direction with respect to the first thread.

In an aspect the first and the second threads are internal, or female, or a nutscrew, and each develop internally of a respect hole in the first column.

In an aspect the body of the device is configured so as to be positioned, on the fixed ring of the bearing structure of the knitting machine, in such a way that the first hole collimates with a corresponding first vertical hole passing through the fixed ring of the bearing structure, and the lower end of the first column, inserted in the first hole of the body, is positioned at the first vertical hole of the fixed ring.

In an aspect the first screw is vertically couplable from above to the first thread, so as to be superiorly solidly constrained to the first column, and the second screw is configured so as to be vertically inserted, from below, during mounting, into the first hole of the fixed ring, and so as to reach, by crossing the first hole of the fixed ring, the second thread of the first column, the second screw being inferiorly solidly constrained to the bearing structure of the knitting machine and to the first column.

In an aspect, in the mounting configuration, the first screw is superiorly abutted on the upper end of the first column and the second screw is inferiorly abutted on the lower surface of the fixed ring of the bearing structure.

In an aspect the first screw is configured for abutting, with the device in the mounting configuration, on the rest surface of the upper end of the first column.

In an aspect the second screw is configured so as to abut, with the device in the mounting configuration, on a lower surface of the fixed ring of the bearing structure of the knitting machine, the respective rest surface of the lower end of the first column being in contact with the rest surface of the fixed ring, opposite the lower surface of the fixed ring.

In an aspect the rest surface of the upper end of the first column is substantially aligned with, or abreast of, the upper surface of the body, and the rest surface of the lower end of the first column is substantially aligned with, or abreast of, the lower surface of the body.

In an aspect, alternative or equivalent to the presence of the screws and the threads, the first fixing means can comprise a pair of fixing organs, for example pins, weld joints, glues, configured for joining the first column to the body and for mounting the body-first column assembly to the fixed ring of the bearing structure of the knitting machine.

In an aspect, the body of the device comprises a second hole passing between the upper surface and the lower surface and crossing an internal portion of the body, and the frame comprises a second column, insertable in the second hole, and second fixing means configured for joining the second column to the body and for mounting the body-first column-second column assembly to the fixed ring of the bearing structure of the knitting machine.

In an aspect the second column and/or the second hole and/or the second fixing means are substantially identical or equivalent to, i.e. exhibit the same characteristics as, respectively the first column and/or the first hole and/or the first fixing means.

The second column, the second hole and the second fixing means preferably exhibit the technical characteristics contained in one or more of the above-cited aspects.

In an aspect the frame comprises a reinforcing element, or plate, interposed between, and connecting, the first column and the second column.

In an aspect the reinforcing element realises, in the mounting configuration of the device to the knitting machine, together with the first column, the second column and the fixed ring of the bearing structure of the knitting machine, a closed-structure frame.

In an aspect the closed structure of the frame defines a closed pathway continuously crossing, in continuity, successive elements of the frame.

In an aspect the closed pathway defines, internally thereof, a space internally of the frame occupied at least partly by the body. In an aspect the body is crossed by the frame and the frame penetrates into the body.

In an aspect the frame and the body are joined and connected (or interconnected) to one another.

In an aspect the first column, the reinforcing element, the second column and the fixed ring of the bearing structure of the knitting machine overall realize a rigid quadrilateral solidly constrained to, and preferably at least partly crossing, the body of the device.

In an aspect the device is a mobile cam device for commanding the needles of a knitting machine, and:

- the body is provided with at least a housing seating configured for movably housing the at least an actuator in the body;
- the command organ is a command cam, movably mounted and associated to the body and destined to interact with at least a needle of knitting machine, preferably with at least a needle of a needle cylinder of a circular knitting machine;
- the actuator is configured for moving the command cam in a controlled way.

In an aspect the device is a thread guide group for supplying thread to the needles of a knitting machine, and

- the above-mentioned body is provided with at least a housing seating configured for movably housing the at least an actuator in the body;
- the command organ is a thread guide movably mounted and associated to the body and destined to dispense a thread to at least a needle of a needle cylinder of a circular knitting machine;
- the actuator is configured for moving the thread guide in a controlled way.

In an independent aspect, the invention relates to a knitting machine, in particular of the circular type for knitwear, hosiery or the like, comprising:

- a bearing structure;
- at least a needle-bearing organ or needle cylinder rotatably mounted to the bearing structure;
- a plurality of needles supported by the needle cylinder and mobile parallel to a rotation axis of the needle cylinder for producing a knitted fabric;
- at least a device according to one or more of the aspects and/or appended claims, configured and predisposed for selectively commanding one or more of the needles of the knitting machine; wherein the bearing structure is provided with a fixed ring developing circumferentially about the needle cylinder, and wherein the at least a device is mounted to the fixed ring of the bearing structure.

In an aspect the fixed ring of the bearing structure comprises a rest surface, configured for restingly receiving a lower surface of the body of the device.

In an aspect the fixed ring of the bearing structure comprises at least a first vertical hole passing between the rest surface and a lower surface of the fixed ring.

In an aspect, the first hole of the body is positioned at the first vertical hole of the fixed ring.

In an aspect the first screw is vertically coupled, from above, to the first thread, so as to be superiorly solidly constrained to the first column, and the second screw is vertically inserted, from below, in the first hole of the fixed ring and reaches, crossing the first hole of the fixed ring, the second thread of the first column, the second screw being inferiorly abutted on the lower surface of the fixed ring and being solidly constrained to the bearing structure of the knitting machine and to the first column.

In an aspect the fixed ring comprises a second vertical hole passing between the rest surface and a lower surface of the fixed ring, the second hole being preferably identical to, and distinct from, the first vertical through-hole.

In an aspect, the second hole of the body is positioned at the second vertical hole of the fixed ring.

In an aspect the first screw of the second fixing means is vertically coupled, from above, to the respective first thread of the second column, in such a way as to be superiorly solidly constrained to the second column, and the second screw of the second fixing means is inserted vertically from below in the second hole of the fixed ring and reaches, crossing the second hole of the fixed ring, the second thread of the second column, the second screw of the second fixing means being inferiorly abutted on the lower surface of the fixed ring and being solidly constrained to the bearing structure of the knitting machine and the second column.

Each of the above-cited aspects of the invention can be taken alone or in combination with any one of the claims or the other described aspects.

Further characteristics and advantages will more fully emerge from the detailed description of some exemplary but non exclusive embodiments, among which also a preferred embodiment, of a command device for a knitting machine according to the present invention. This description will be set down in the following with reference to the accompanying drawings, supplied by way of non-limiting example, in which:

FIG. 1 illustrates a perspective view of a possible embodiment of a command device (for example of a mobile cam type) of the present invention, mounted by way of example to a fixed structure of a circular knitting machine;

FIG. 2 is a further perspective view of the device of FIG. 1;

Figure 3:
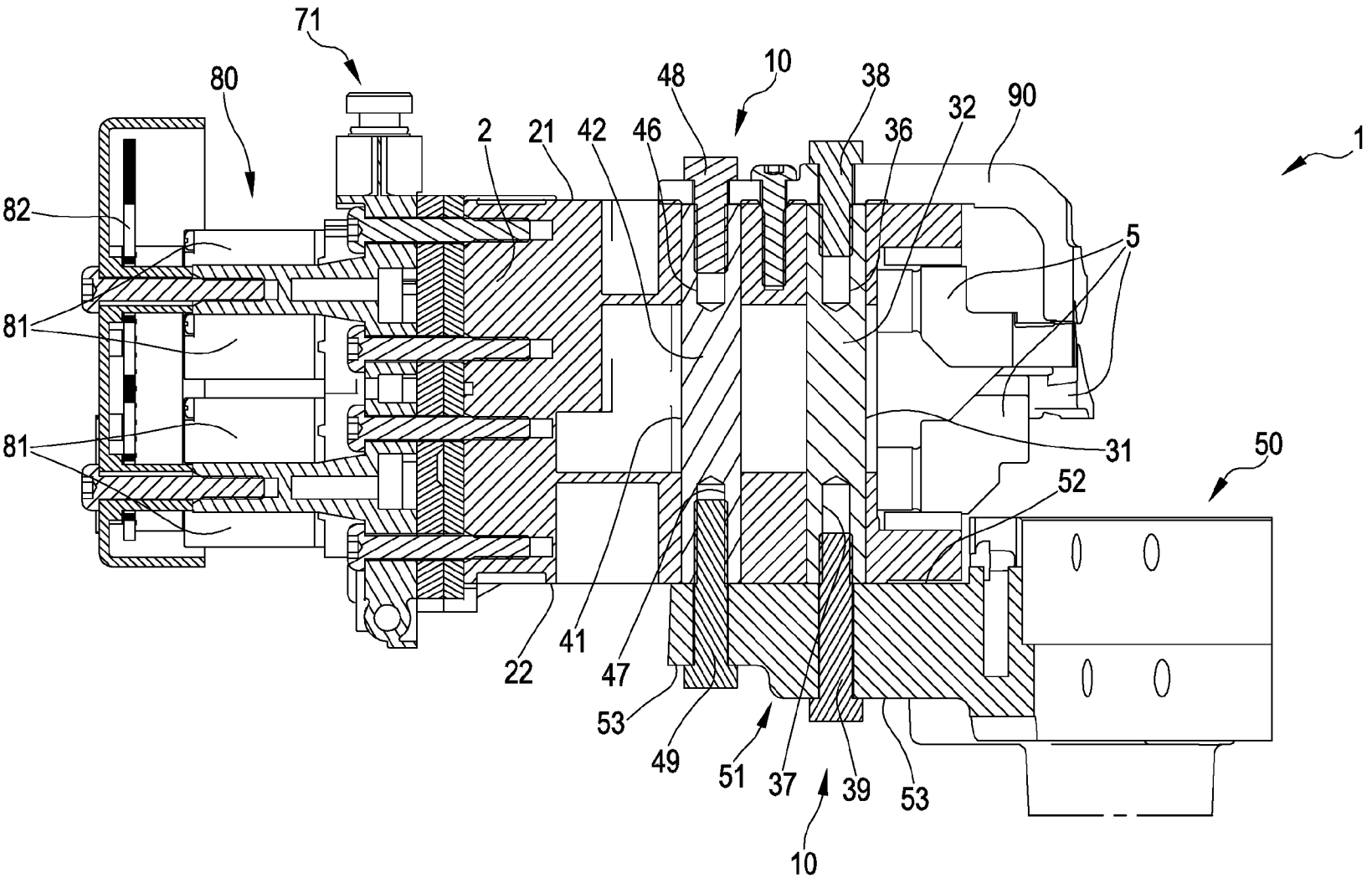
FIG. 3 is a lateral view of the device of FIG. 1, sectioned along a longitudinal plane passing through the rotation axis of the needle cylinder of the knitting machine and intersecting the frame.
Figure 4:
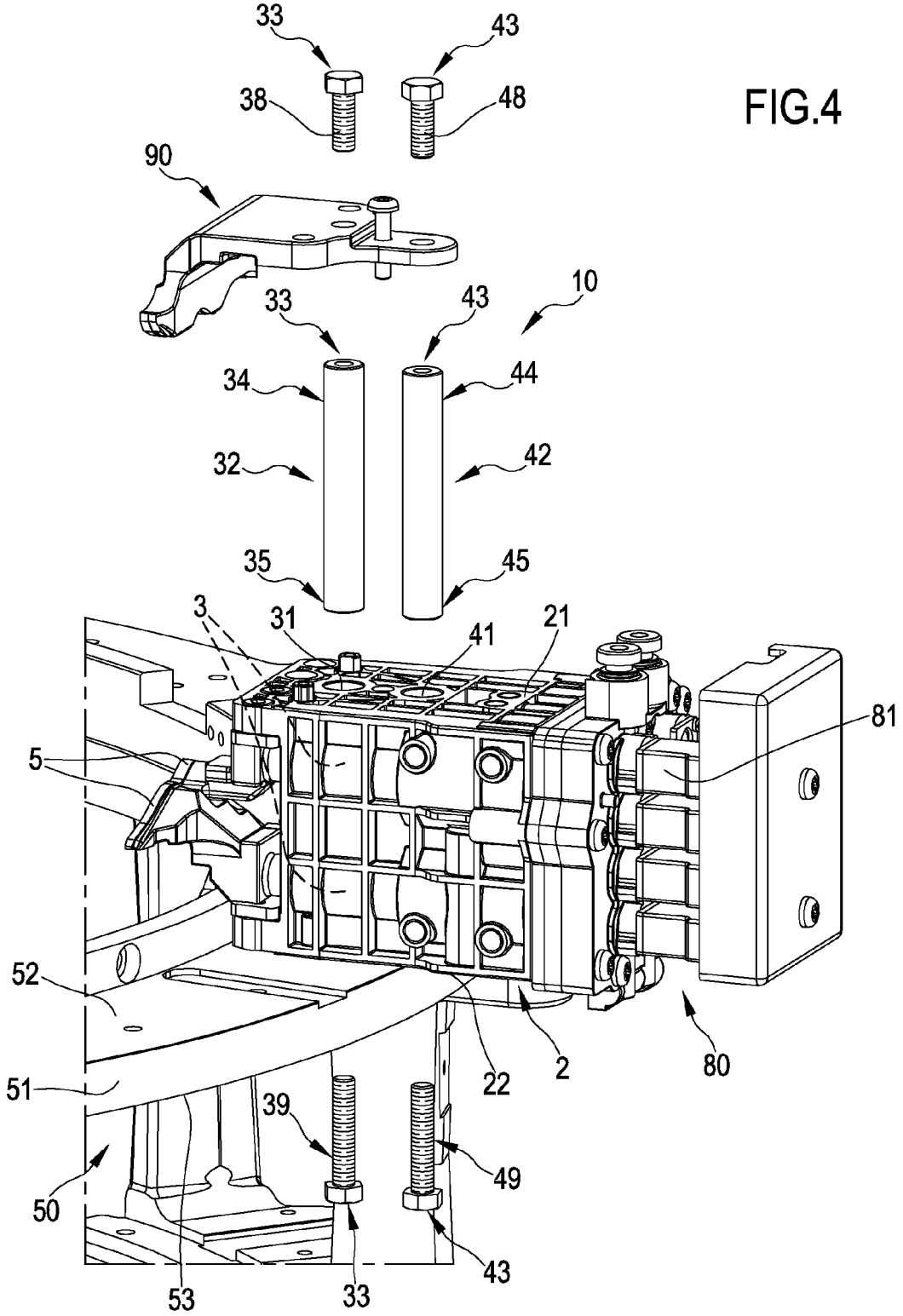
FIG. 4 is a perspective view, partially exploded, of the device of FIG. 1.

With reference to the figures of the drawings, number 1 denotes in its entirety a command device for a knitting machine according to the present invention. In general, the same reference number is used for equal or like elements, possibly in variant embodiments thereof.

The device of the present invention is destined to be located in any knitting machine for commanding the needles which interact with the threads for the formation of the knitting stitch; the device in particular is apt for use on circular knitting machines. The knitting machine, except for part of the bearing structure, and the relative needles are not shown in the figures, as they are of known type and conventional type. The present invention is appropriate for use both in new machines and machines already in existence, in the latter case for replacing command devices of a traditional type. The functioning of the whole knitting machine (for example the interaction between the command cams and the needles, the cooperation between needles and threads, etc.) is not described in detail, as it is known in the technical sector of the present invention.

By way of example, the figures illustrate a command device of the "mobile cam for needle command" type of a knitting machine. However the present invention is applicable and adaptable, in a technically equivalent way, to any command device for knitting machines that can be positioned on the knitting head of a knitting machine and cooperate with elements of the knitting machine. Non-exclusive examples of further command devices for knitting machines, in addition to the mobile cam device shown in the figures, are represented by the thread guide group and the clamps groups.

The device 1 illustrated in the figures comprises:

- a body 2 provided with at least a housing seating 3 configured for movably housing at least an actuator internally of the body;
- at least a command cam 5 movably mounted and associated to the body 2 and destined to interact with at least a needle of a needle bed of the knitting machine, preferably with at least a needle of a needle cylinder of a circular knitting machine;
- at least an actuator, movably housed at least partially in the housing seating 3 and destined to controllingly move the command cam 5.

The device 1 further comprises a support frame 10, associated to the body and configured for increasing the structural solidity of the body.

The support frame 10 is preferably structured so as to mount the body, according to a determined mounting configuration, to a bearing structure 50 of the knitting machine. The determined mounting configuration comprises at least a mounting position of the body 2 with respect to the bearing structure 50 of the knitting machine.

As shown by way of example in the figures, the support frame 10 is preferably distinct from the body 2 of the device. The above-mentioned determined mounting configuration preferably defines a predetermined blocking force, guaranteed by the support frame on the body in the mounting configuration of the device to the bearing structure of the knitting machine. The blocking force defined by the frame is preferably substantially constant for each mounting of the device to the bearing structure of the machine. In other words, even when removing and replacing a device with a further identical device, or repositioning the same device, the frame defines a fixed blocking force with which the mounting of the device to the knitting machine is performed. The blocking force is preferably such as to prevent a compression and/or a deformation of the body 2 during mounting of the device 1 to the bearing structure 50 of the knitting machine.

The body 2 of the device is preferably one only for the whole device, i.e. the body is a single block. The body of the device is preferably made in a single piece.

The body 2 of the device and the frame 10 are preferably made of different materials. The body 2 is preferably entirely made of a single material, and the frame 10 is entirely made of a single respective material. The body is preferably made of a plastic material, preferably a polymer material and/or a plastic material comprising a percentage of carbon (or a similar material) preferably at least 10% in weight and/or 20% in weight and/or 30% in weight. The body is preferably made of a composite material, for example a mixture of various plastics (for example nylon) and/or fiberglass and/or carbon fibre. The body is preferably made of a material suitable for moulding. The frame is preferably made of a metal material, for example steel, iron, aluminium or alloys thereof. The presence of the support frame 10 is useful in particular in the case of a body 2 made of a plastic material. In fact the mounting by framing enables obtaining a definite blocking force, and thus prevents that in any step of mounting of the device the body is subjected to excessive blocking forces which might "crush" and deform a body made of a plastic material.

The device 1 is destined to be mounted preferably to a fixed ring 51 of the bearing structure 50 of a circular knitting machine; the fixed ring develops circumferentially about the needle cylinder of the circular knitting machine. The fixed ring 51, also known as a plate or base, constitutes a part of the knitting head and supports the devices which cooperate with the needle cylinder.

The frame 10 preferably at least partly crosses the body 2 of the device, reaching, in the mounting configuration, the underlying bearing structure 50 of the knitting machine.

The body 2 of the device preferably exhibits an upper surface 21 and a lower surface 22. As shown by way of example in the figures, the lower surface of the body, among the various external surface of the body, is preferably the one destined to rest on a rest surface 52 of the fixed ring 51 of the bearing structure 50 of the knitting machine.

As in the embodiment shown by way of example in the figures, the body 2 of the device preferably comprises at least a first hole 31 passing through the upper surface 21 and the lower surface 22 and crossing an internal portion of the body 2, and the frame 10 comprises at least a first column 32, insertable in the first hole 31, and first fixing means 33 configured so as to join the first column 32 to the body 2 and so as to mount the body—first column assembly to the fixed ring of the bearing structure of the knitting machine.

The first hole 31 preferably extends vertically between the upper surface and the lower surface and is perpendicular thereto.

The first hole 31 preferably has a circular section, still more preferably a constant section. In general terms, the first column 32 is preferably complementarily-shaped to the first hole.

Figure 5:
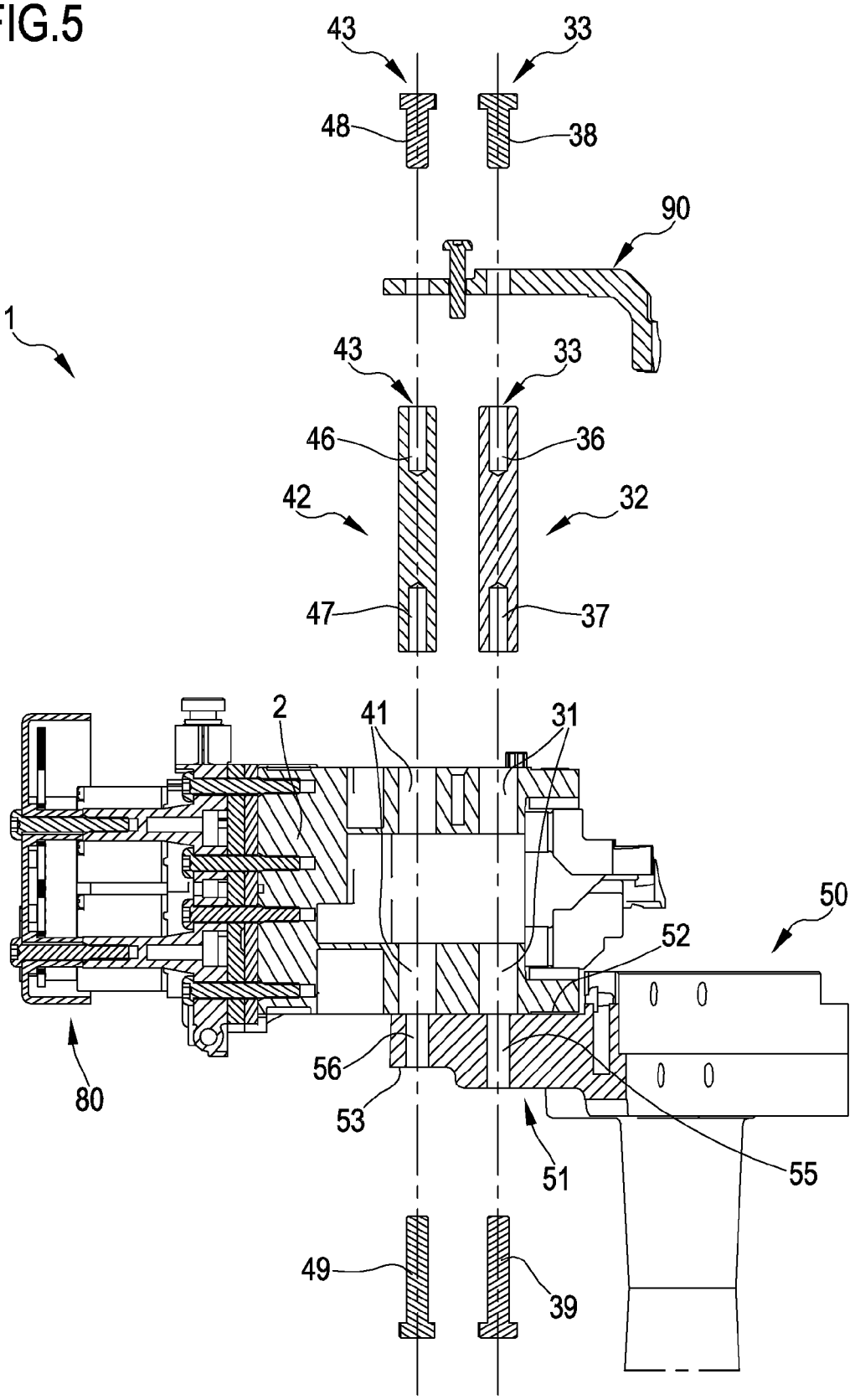
FIG. 5 is a further lateral view of the device of FIG. 1, exploded and sectioned along the same plane as FIG. 3.

The first hole can extend in continuity between the upper and lower surfaces, i.e. it can consist in a uniform passage between the two surfaces realised in the material the body is made of. Alternatively, and equivalently for the purposes of the present invention, and as shown in FIGS. 3 and 5, the first hole can comprise an upper portion, starting from the upper surface and extending for a tract internally of the body, and a lower portion, starting from the lower surface and extending for a tract internally of the body in an opposite direction to the first portion, the two portions being coaxial to one another; between the two portions, the first hole opens into an internal cavity of the body (preferably empty). In this embodiment, the first hole is able, by means of the upper and lower portions thereof (coaxial and complementarily-shaped to the first column), of being crossed by, and stably housing, the first column. In substance, the first column is inserted in the upper portion of the first hole, proceeds in the internal cavity (in which it is not laterally contained) and then crosses the lower portion. The two portions house and laterally contain the column in two different points.

The first column 32 preferably extends longitudinally between an upper end 34, positioned (with the device mounted) in proximity of the upper surface 21 of the body, and a lower end 35, opposite the upper end and positioned (with the device mounted) in proximity of the lower surface 22 of the body.

The first fixing means 33 preferably comprise a first thread (or tapping) 36, realised on the upper end 34 of the first column 32, and a second thread (or tapping) 37 realised on the lower end 35 of the first column. The first fixing means 33 preferably comprise a first screw 38 and a second screw 39; the first screw is configured for coupling with the first thread and the second screw is configured for coupling with the second thread.

The upper end 34 and the lower end 35 of the first column 32 preferably each define a respective rest surface perpendicular to the longitudinal development of the first column. The first thread extends on the first column (or in the first column) starting from the rest surface of the upper end, while the second thread extends on the first column (or in the first columns) starting from the rest surface of the lower end and in the opposite direction with respect to the first thread.

As shown by way of example in the figures, the first 36 and the second thread 37 are preferably internal, or female, and each develop internally of a respective hole in the first column. The holes in the first column in which the two threads are realised start respectively from the upper and lower end of the column.

In general, the fixing means preferably realise one or more (two in the figures) threaded couplings between the body 2 and the frame 10, and, at the same time, between the body-frame assembly and the bearing structure of the knitting machine.

The body 2 of the device is preferably configured so as to be positioned, on the fixed ring 51 of the bearing structure 50 of the knitting machine, in such a way that the first hole 31 collimates with a corresponding first vertical hole 55 passing through the fixed ring 51 of the bearing structure; further, the lower end 35 of the first column 32, inserted in the first hole 31 of the body, is positioned at the first vertical hole 55 of the fixed ring.

The first screw 38 is preferably vertically coupled, from above, to the first thread 36, in such a way as to be superiorly solidly constrained to the first column 32, and the second screw 39 is configured so as to be vertically inserted, from below, during mounting, into the first hole 55 of the fixed ring, and reaches, by crossing the first hole 55 of the fixed ring, the second thread 37 of the first column, the second screw being inferiorly solidly constrained to the bearing structure of the knitting machine and the first column.

As can be observed in particular in FIG. 3, the first 38 and the second screw 39 realise, respectively superiorly and inferiorly, a stacked mounting of the body of the device to the fixed ring, the body being thus fixed to the bearing structure, on opposite sides and in opposite blocking directions, by means of the first and the second screw.

In the mounting configuration, the first screw 38 is preferably superiorly abutted on the upper end of the first column, and the second screw is inferiorly abutted on the lower surface of the fixed ring of the bearing structure.

The first screw 38 is preferably configured for abutting, with the device in the mounting configuration, on the rest surface of the upper end of the first column. The second screw 39 is preferably configured for abutting, with the device in the mounting configuration, on a lower surface 53 of the fixed ring 51 of the bearing structure 50, the respective rest surface of the lower end 35 of the first column 31 being in contact with the rest surface 52 of the fixed ring, opposite the lower surface 53 of the fixed ring.

In substance, the first screw superiorly abuts the body, while the second screw is not in contact with the lower surface of the body, as it is inserted from below into the vertical hole of the fixed ring and through it reaches the column; the second screw is, in the mounting configuration, in contact with the lower surface of the fixed ring.

The rest surface of the upper end 34 of the first column is preferably substantially aligned, or abreast of, the upper surface 21 of the body, and the rest surface of the lower end 35 of the first column is substantially aligned with, or abreast of, the lower surface 22 of the body.

As in the embodiment shown by way of example in the figures, the body 2 of the device preferably further comprises a second hole 41 passing between the upper surface 21 and the lower surface 22 and crossing an internal portion of the body. In this case, the frame 10 comprises a second column 42, insertable in the second hole, and second fixing means 43 configured for joining the second column to the body and for mounting the body-first column-second column assembly to the fixed ring of the bearing structure of the knitting machine.

The second hole 41, the second column 42 and the second fixing means 43 are preferably substantially identical or equivalent to, i.e. they exhibit the same characteristics as, respectively the first hole, the first column and the first fixing means.

In greater detail, as shown by example in the figures, the second column 42 extends longitudinally between a respective upper end 44, positioned in proximity of the upper surface 21 of the body, and a lower end 45, opposite the upper end and positioned (with the device mounted) in proximity of the lower surface 22 of the body. The second fixing means 43 preferably comprise a respective first thread 46, realised on the upper end 44 of the second column 42, and a respective second thread 47 realised on the lower end 45 of the second column. The second fixing means 43 preferably comprise a respective first screw 48 and a respective second screw 49; the first screw is configured for coupling with the first thread and the second screw is configured for coupling with the second thread.

The upper end 44 and the lower end 45 of the second column 42 preferably each define a respective rest surface perpendicular to the longitudinal development of the second column. As shown by way of example in the figures, the first 46 and the second thread 47 of the second fixing means are preferably internal, or female, and each develop internally of a respective hole in the second column.

The body 2 of the device is preferably configured for being positioned, on the fixed ring 51 of the bearing structure 50, in such a way that the second hole 41 collimates with a corresponding second vertical hole 56 passing through the fixed ring 51, and the lower end 45 of the second column 42, inserted in the second hole 41 of the body, is positioned at the second vertical hole 56 of the fixed ring.

The first hole 31 and the second hole 41 of the body 2 are preferably distinct from one another and are separated by a distance of greater than 1 mm and/or greater than 5 mm and/or greater than 10 mm and/or greater than 20 mm and/or greater than di 50 mm.

The first hole 31 and the second hole 41 preferably develop longitudinally parallel to one another; in this case the distance between them is constant over the whole longitudinal development of the two holes.

The first hole 31 and the second hole 41 preferably have a respective longitudinal axis, the two longitudinal axes lying on a vertical plane passing (when the device is mounted) through a rotation axis of the needle cylinder, as shown in the figures. The longitudinal axes of the first hole and the second hole are preferably aligned along a radial direction with respect to the rotation axis of the needle cylinder; in this case the first hole is closer to the rotation axis of the needle cylinder with respect to the second hole.

The upper surface 21 and the lower surface 22 of the body 2 of the device are preferably parallel to one another and positioned horizontally, with the device mounted on the knitting machine.

In a possible embodiment, not illustrated, the body comprises a third hole and the frame comprises a third column and third fixing means, the elements being substantially identical or equivalent to, i.e. exhibiting the same characteristics as, respectively the first or second hole, the first or second column and the first or second fixing means. In this case the first hole preferably has the respective longitudinal axis lying on a vertical plane passing through, or parallel to, a rotation axis of the cylinder, while the respective longitudinal axes of the second hole and the third hole lie in opposite semi-spaces with respect to the vertical plane, i.e. are positioned in the body on opposite sides with respect to the first hole. The longitudinal axes of the second hole and the third hole are preferably aligned along a perpendicular direction with respect to the vertical plane and/or are more distanced from the rotation axis of the needle cylinder with respect to the first hole.

In an alternative and equivalent aspect to the presence of the screws and the threads, the first fixing means can comprise a pair of fixing organs, for example pins, weld joints, glues, configured for joining the first column to the body and for mounting the body-first column assembly to the fixed ring of the bearing structure of the knitting machine.

Likewise, the second fixing means can comprise a respective pair of fixing organs, for example pins, weld joints, glues configured for joining the second column to the body and for mounting the body-first column-second column assembly to the fixed ring of the bearing structure. The mounting of the body 2 and the frame 10 to the bearing structure 50 of the knitting machine is preferably removable. The use of threaded couplings as fixing means enables this removable mounting.

In the embodiment shown in the figures, the first hole 31 and the second hole 41 develop between the upper surface 21 and the lower surface 22 of the body 2. Alternatively, in further embodiments that are not shown, the first and/or the second hole can develop between a rear or lateral face of the body and the lower surface, equivalently to what is illustrated. In general, the first and/or the second hole terminate preferably on the surface of the body destined to be located on the fixed ring and fixed there (typically the lower surface) on the basis of the orientation assumed by the device in the mounting configuration to the knitting machine. In other embodiments, the first and/or the second hole can develop between two lateral faces of the body or between a lateral face and a rear face of the body.

The first hole and/or the second hole are preferably realised in the body in such a way as not to intersect or intercept the housing seatings 3 which house the actuators and the command cams. The frame preferably comprise a reinforcing element, or plate, interposed between and connecting at least the first column and the second column.

The reinforcing element is preferably positioned superiorly with respect to the body, and is configured so as to connect to the upper end of the first column and the upper end of the second column. The reinforcing element is preferably solidly constrained to the body. The reinforcing element is preferably positioned on the upper surface of the body.

The reinforcing element realises, in the mounting configuration of the device to the knitting machine, together with the first column, the second column and the fixed ring of the bearing structure of the knitting machine, a closed-structure frame. The closed structure of the frame preferably defines a closed pathway continuously crossing, in continuity, successive elements of the frame. The closed pathway preferably defines, internally thereof, a space internally of the frame occupied at least partly by the body. In substance, the body is crossed by the frame, and the frame penetrates into the body.

The first column, the reinforcing element, the second column and the fixed ring of the bearing structure of the knitting machine preferably overall realize a rigid quadrilateral solidly constrained to, and preferably at least partly crossing, the body of the device.

The reinforcing element is preferably interposed between the first screw of the first fixing means and the upper end of the first column, and is further interposed between the first screw of the second fixing means and the respective upper end of the second column.

The reinforcing element preferably comprises a respective first through-hole, configured for being crossed by the first screw of the first fixing means, which through the first hole reaches the first column, and comprises a respective second through-hole, configured for being crossed by the respective first screw of the second fixing means, which reach, through the second hole, the second column.

The reinforcing element is preferably solidly constrained to the first fixing means (preferably the first screw), to the first column, to the second fixing means (preferably to the respective first screw), to the second column and to the body of the device.

As shown by way of example in the figures, the device 1 can further comprise (optionally) a fixed return cam 90, mounted superiorly of the body and emerging frontally therefrom. The return cam is preferably interposed between the first screw 38 of the first fixing means 33 (and/or the respective first screw 48 of the second fixing means 43) and the upper surface 22 of the body 2, so as to be solidly constrained to the body by means of the first fixing means and/or the second fixing means. In this case the return cam 90 comprises a respective first through-hole, configured for being crossed by the first screw 38 of the first fixing means 33, which thus reaches the first column, and possibly comprises a respective second through-hole, configured for being crossed by the respective first screw 48 of the second fixing means 43, which thus reaches the second column.

The return cam is thus mounted to the body by the fixing means 33 and/or 43, in particular vertically blocked between the first screws and the upper surface of the body, and becomes solidly constrained to the frame of the device.

The return cam 90 is fixed superiorly on the body (and partially projects frontally to the body); the return cam is not moved but interacts with the needles during the rotation of the cylinder. In this way the return ("descent") of the needles into the lowered position can be commanded, which were previously activated by a command cam, according to a determined knitting pattern.

The return cam 90 shown in the figures preferably constitutes the reinforcing element (or plate) interposed between, and connecting, the first and the second column. In other words, the return cam, which in the embodiment shown in the figures carries out a knitting function (return of the needles into the lowered position) coincides with the reinforcing element, which connects (in this case superiorly) the two columns to one another and creates a closed-structure frame (together with the fixed ring of the bearing structure).

The mobile cam device 1 of the present invention preferably comprises an air inlet 71 positioned on the body 2 and destined to be connected to a source of compressed air, not shown as of known type and constituted, for example, by a compressor or a tank on-board the knitting machine or in the room where the machine is installed.

As described above, the body 2 comprises at least a housing seating 3, to which a respective command cam 5 is associated, and a respective actuator, typically pneumatic, which moves the command cam in a controlled way.

The command cam 5 comprises an engaging portion, operatively connected to the actuator for receiving therefrom the movement, and an operating portion, emerging from the respective housing seating and facing, with the device mounted on the machine, towards the needles of the needle cylinder. The engaging portion can have a substantially cylindrical shape, for inserting internally of the seating of the body, while the operating portion comprises an open cam profile, typically variously curvilinear. When the operating portion of the cam cooperates with a needle, in motion with respect thereto (thanks for example to the rotation of the needle cylinder), it forces the movement thereof along a vertical direction, substantially perpendicular to the motion of the cylinder.

The operating portion typically comprises a cam profile having an initial point and a final point and developing in such a way as to create a determined law of motion for the needle on passage thereof on the cam. The figures illustrate example cam profiles: on the basis of the type of stitch and/or working, a specific command cam can be selected to associate to the device of the present invention.

For the aims of the present invention, consider that the command cams are destined to act directly on the "butts" of the needles, such that the needles raise and lower to carry out the knitting operations.

Each actuator of the device 1 preferably comprises a first piston selectively translatable in the respective seating 3 at least between a first position in which it is retracted in the seating at the bottom end, and a second position in which it is advanced in the seating towards a head end. More preferably, each actuator further comprises a second piston housed in the respective seating of the actuator in series with the first piston, i.e. downstream of the first piston with respect to a longitudinal development of the seating from the bottom end to the head end. The second piston is selectively translatable in the seating between a respective first position, in which it is retracted in the seating and headed abuttingly on a head surface of the first piston, and a respective second position in which it is advanced in the first seating with respect to the head surface of the first piston towards the head end of the seating.

The device 1 preferably further comprises at least a first solenoid valve 81 for each actuator, mounted and connected directly to the body of the device and active directly at least on a respective air pathway, so as to selectively enable or prevent passage of air in the air pathway so as to selectively activating the first piston of the respective actuator. The device more preferably further comprises a second solenoid valve 81 for each actuator, mounted and connected directly to the body of the device and active directly on a respective air pathway, so as to selectively enable or prevent passage of air into the air pathway for the purpose of selectively activating the second piston of the respective actuator.

Each actuator, when it comprises both the first and the second piston, is preferably configured so as to selectively operate at least between the following operating configurations:

- a retracted configuration, in which the first and the second solenoid valve close the air passage respectively in the respective air pathway, and the first and the second piston are both in the first position, the engaging portion of the corresponding cam 5 being retracted in the respective seating;
- an intermediate configuration, in which the first solenoid valve enables passage of air in the respective air pathway and the second solenoid valve prevents passage of air into the respective air pathway, the first piston being in the respective second position and the second piston being in the respective first position, the engaging portion of the cam being partially advanced in the respective seating;
- an advanced configuration, in which the first solenoid valve and the second solenoid valve enable passage of air in the respective air pathway, and the first and the second piston are both in the respective second position, the engaging portion of the first cam being completely advanced in the respective seating.

Each actuator therefore preferably comprises two distinct pistons, actuable independently of the two solenoid valves 81 thus enabling obtaining three different advancements for the corresponding command cam. The presence of two distinct pistons for each actuator, arranged in series in such a way as to define three different positions (or configurations) for the actuator, does not constitute a mere arbitrary choice but is aimed at a precise purpose, considerably important for numerous knitting machines, in particular circular knitting machines.

The device 1 preferably comprises electronic control means 80 configured and predisposed to manage the functioning of the device, in particular in order to command the solenoid valves 81 of the device and to interface the device with a central unit of the knitting machine (not illustrated).

The electronic control means can receive the instructions relating to the management of the device by the central unit of the knitting machine or can themselves process the control instructions for the device.

The electronic control means preferably comprise an electronic board 82 associated (preferably directly mounted) to the body 2.

The housing seating-actuator-command cam assembly described above, where the actuator preferably comprises two pistons activated by two solenoid valves, can be present once only in the device (in which case the device is defined in the sector with the term "single cam", as indeed it commands a single needle cam), or it can be repeated more than once internally of the device, such that it comprises a plurality of command cams activatable singly and independently.

In greater detail, the mobile cam device can comprise a second housing seating 3, a second actuator and a second command cam 5, preferably having the same technical characteristics described above for the same components. In this configuration the device is called "dual cam", as it enables independent command of two distinct needle cams.

The device of the present invention can advantageously also comprise a third actuator, preferably identical to the actuator described above, so as to controlledly move a third needle command cam; in this case the device is known as a "triple-cam" device. The device of the present invention can advantageously comprise also a fourth actuator, preferably identical to the actuator described above, such as to controlledly move a fourth needle command cam; in this case the device is known as a "quadruple-cam" device.

The device 1 illustrated in figures relates, without constituting any limitation for the invention, to the complete configuration, i.e. the one comprising four distinct commands for four distinct cams; the device of the present invention can, when needed, integrate a greater number of actuators and/or command cams and/or solenoid valves (on the basis of the number of cams which are to be commanded and/or the required movements).

As illustrated in figures, the body 2 of the device 1 comprises a rear side, on which the solenoid valves of the actuators are positioned and mounted, and a front side, opposite the rear side, destined to be facing toward the needles of the knitting machine and on which open the seatings, from which emerge the command cams.

The body 2 can further comprise an air outlet 72 destined to be connected to a respective air inlet of a further device 1 for commanding needles or another user device using compressed air.

In other words, the compressed air flow coming from the compressed air source can reach the device of the present invention by means of the air inlet 71, supply the internal air pathways of the body and proceed beyond the body exiting from the air outlet 72; in this way, by connecting, by means of an external air conduit (for example a tube or the like), the air outlet of the body 2 to the inlet of a further device, it is possible to supply the further device directly in series with the first, without any need to connect the further device singly to the pressure source.

Figure 6:
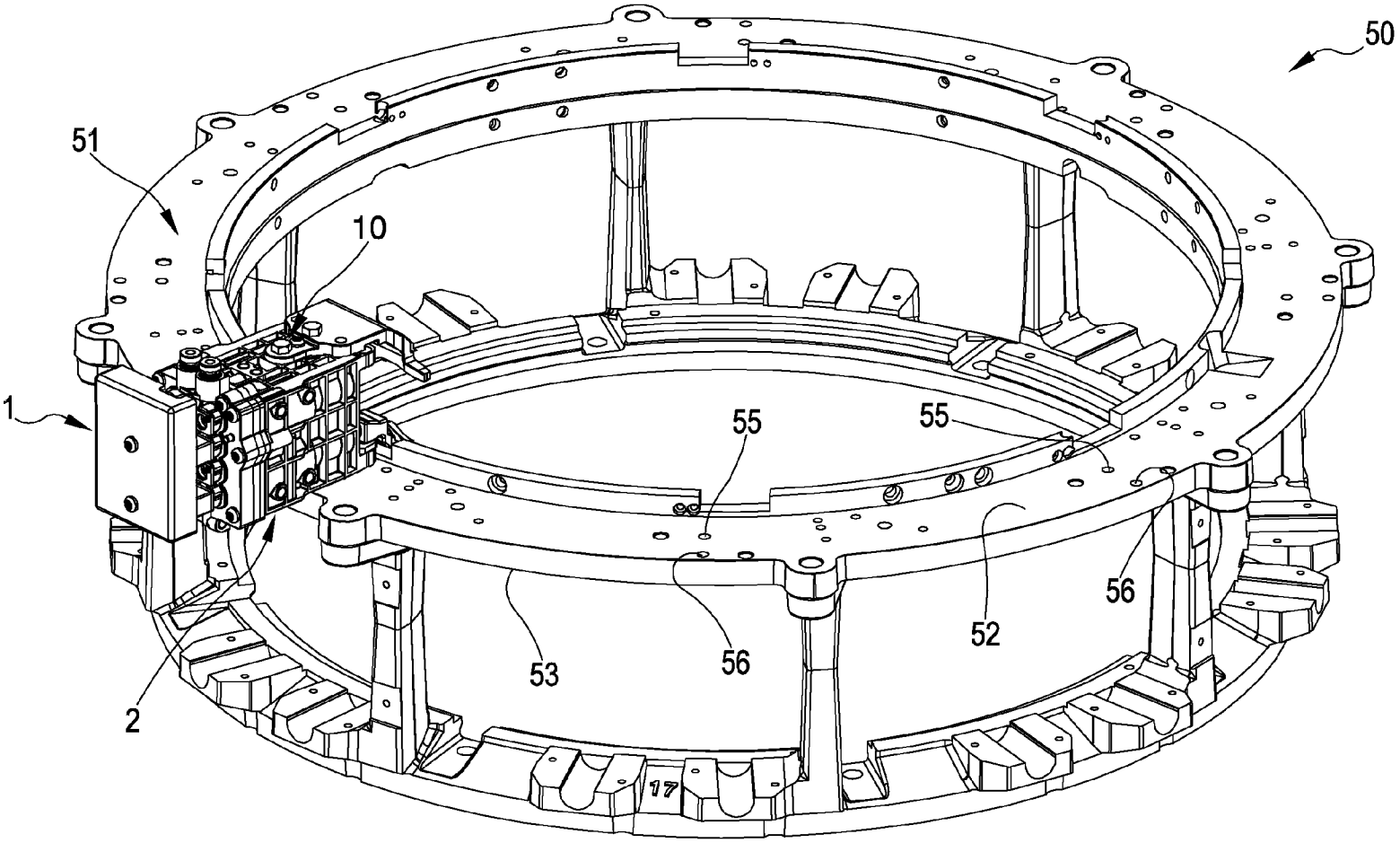
FIG. 6 is a further perspective view of the device of FIG. 1, mounted on a fixed structure of a circular knitting machine, illustrated by way of example and with some parts removed.

As described above, the device 1 is destined to be mounted on a knitting machine, preferably circular. FIG. 6 shows a part of the bearing portion 50 of the machine, and in particular the fixed ring 51. A mobile cam device is illustrated by way of example, in a mounting configuration. It is clear that a complete circular knitting machine is provided with a plurality of mobile cam devices, preferably of the type of the present invention. This plurality typically comprises a number of devices 1 equal to the number of thread feeders of the knitting machine (i.e. each device 1 is singly dedicated to a respective thread feeder), with the devices distributed angularly (preferably uniformly) on the fixed ring. Alternatively, according to needs, this plurality can comprise a different number of mobile cam devices.

The invention as it is conceived is susceptible to numerous modifications and variants, all falling within the scope of the inventive concept, and the cited components can be replaced by other technically-equivalent elements. The invention achieves important advantages. Primarily, the invention enables obviating at least some of the drawbacks of the prior art.

The present invention advantageously enables realizing a precise, simple and rapid mounting of a command device on the bearing structure of a knitting machine.

Further, the device of the present invention is versatile, modular and easily adaptable to different circular knitting machines.

A further advantage of the device of the present invention is that it has a simple and rational structure. The device of the present invention further enables reducing mounting errors.

Further, the device is more reliable, resistant to faults and is characterised by a longer working life than known devices. Further, the device of the present invention requires a smaller degree of maintenance. The device of the present invention is further simple and/or sturdy and/or economical to realize.

A further advantage of the device of the present invention is that a mounting can be realised with a determined blocking force, which prevents compression of the body of the device, in particular when made of a plastic material.

A further advantage of the present invention is the presence of a support frame, which provides the body of the device with the necessary structural solidity, as well as enabling mounting thereof to the knitting machine.

The invention claimed is:

1. A command device (1) for a knitting machine, the device comprising:

a body (2) of the device configured for movably housing at least an actuator;

at least a command element (5) movably mounted and connected to the body (2) and configured to interact with one or more needles of a knitting machine or with one or more threads infeeding into a knitting machine;

at least an actuator, movably housed at least partially in the body (2) and configured to controlledly move the command element (5), the device (1) comprising a support frame (10), connected to the body (2), wherein the support frame (10) at least partially crosses the body (2) of the device, reaching, in the assembly configuration, a bearing structure (50) of the knitting machine, and wherein the support frame (10) is configured for increasing the structural solidity of the body (2).

2. The device (1) of claim 1, wherein the support frame (10) is configured for mounting the body, according to a determined mounting configuration, to a bearing structure (50) of the knitting machine, the determined mounting configuration of the knitting machine comprising at least a mounted position of the body (2) with respect to the bearing structure (50) of the knitting machine.

3. The device (1) of claim 1, wherein the body (2) of the device and the frame (10) are made of different materials, and wherein the body (2) is entirely made of a single material and the frame is entirely made of a single material, or wherein the body (2) is made of a polymer material or a plastic material comprising a percentage of carbon of at least 10% in weight or 20% in weight or 30% in weight, and the frame (10) is made of steel, iron, aluminium or alloys thereof.

4. The device (1) of claim 1, configured to be mounted to a fixed ring (51) of the bearing structure (50) of a circular knitting machine (51) developing circumferentially about the needle cylinder of the circular knitting machine, and wherein the body (2) of the device exhibits an upper surface (21) and a lower surface (22), the lower surface (22) of the body being configured to rest on a rest surface (52) of the fixed ring (51) of the bearing structure (50) of the knitting machine.

5. The device (1) of claim 1, wherein the body (2) comprises at least a first hole (31) passing through the upper surface (21) and the lower surface (22) and crossing an internal portion of the body (2), and the frame (10) comprises at least a first column (32), insertable in the first hole, and first fixing means (33) configured for joining the first column (32) to the body (2) and for mounting the assembly of the body-first column to the fixed ring (51) of the bearing structure (50) of the knitting machine.

6. The device (1) of claim 5, wherein the first column (31) extends longitudinally between an upper end (34), positioned in proximity of the upper surface (21) of the body, and a lower end (35), opposite the upper end and positioned in proximity of the lower surface (22) of the body (2).

7. The device (1) of claim 5, wherein the body (2) of the device is configured for positioning, on the fixed ring (51) of the bearing structure (50) of the knitting machine, in such a way that the first hole (31) collimates with a corresponding first vertical hole (55) passing through the fixed ring (51) of the bearing structure, and the lower end (35) of the first column (32), inserted in the first hole of the body, is positioned at the first vertical hole (55) of the fixed ring.

8. The device (1) of claim 5, wherein the body (2) of the device comprises a second hole (41) passing between the upper surface (21) and the lower surface (22) and crossing an internal portion of the body, and the frame (10) comprises a second column (42), insertable in the second hole, and second fixing means (43) configured for joining the second column to the body and for mounting the body-first column-second column assembly to the fixed ring of the bearing structure of the knitting machine.

9. The device (1) of claim 8, wherein the first hole (31) and the second hole (41) of the body (2) are distinct from one another and are separated by a distance of greater than 1 mm or greater than 5 mm or greater than 10 mm or greater than 20 mm, or wherein the first hole (31) and the second hole (41) have a respective longitudinal axis, the two longitudinal axes being parallel to one another and lying on a vertical plane passing through a rotation axis of the cylinder and/or wherein the longitudinal axes of the first hole (31) and the second hole (41) are aligned along a radial direction with respect to the rotation axis of the needle cylinder, the first hole being closer to the rotation axis of the needle cylinder with respect to the second hole.

10. The device (1) of claim 8, wherein the frame comprises a reinforcing element interposed between, and connecting, the first column and the second column, and wherein the reinforcing element is positioned superiorly with respect to the body and is configured for connecting to the upper end of the first column and to the upper end of the second column, and wherein the reinforcing element realizes, in the mounted configuration of the device to the knitting machine, together with the first column, the second column and the fixed ring of the bearing structure of the knitting machine, a closed-structure frame.

11. The device (1) of claim 1, wherein the command element is a command cam, movably mounted and connected to the body and configured to interact with at least a needle of a knitting machine.

12. The device (1) of claim 1, wherein the command element is a thread guide movably mounted and connected to the body and configured to dispense a thread to at least a needle of a circular knitting machine.

13. The device (1) of claim 2, wherein the determined mounting configuration defines a predetermined blocking force, guaranteed by the support frame (10) on the body (2) in the mounted configuration of the device to the bearing structure (50) of the knitting machine, and wherein the blocking force is such as to prevent a deformation of the body (2) during the mounting of the device (1) to the bearing structure (50) of the knitting machine.

14. The device (1) of claim 2, wherein the body of the device is made in a single piece.

15. The device (1) of claim 5, wherein the first fixing means (33) realize one or more threaded couplings between the body (2) and the frame (10) or between the body-frame assembly and the bearing structure (50) of the knitting machine.

16. The device (1) of claim 6, wherein the first fixing means (33) comprise a first thread (36), realized on the upper end (34) of the first column, and a second thread (37) realised on the lower end (35) of the first column (32), and wherein the first fixing means (33) comprise a first screw (38) and a second screw (39), the first screw (38) being configured for coupling with the first thread (36) and the second screw (39) being configured for coupling with the second thread (37).

17. The device (1) of claim 7, wherein the first screw (38) is vertically couplable from above to the first thread (36), so as to be superiorly solidly constrained to the first column (32), and the second screw (39) is configured so as to be vertically inserted, from below, during mounting, into the first hole (55) of the fixed ring (51), and so as to reach, by crossing the first hole of the fixed ring, the second thread (37) of the first column (32), the second screw (39) being inferiorly solidly constrained to the bearing structure of the knitting machine and the first column, and wherein the first screw (38) and the second screw (39) realize, respectively superiorly and inferiorly, a stacked assembly of the body (2) of the device to the fixed ring (51) of the bearing structure of the knitting machine, the body being fixed to the bearing structure, on opposite sides and in opposite blocking directions, by means of the first and second screw.

18. The device (1) of claim 8, wherein the second column (42) and the second hole (41) and the second fixing means (43) are substantially identical or equivalent to respectively the first column (32) and the first hole (31) and the first fixing means (33).

19. The device (1) of claim 9, wherein the body comprises a third hole and the frame comprises a third column and third fixing means, the elements being substantially identical or equivalent to respectively the first or second hole, the first or second column and the first or second fixing means, and wherein the first hole has the respective longitudinal axis lying on a vertical plane passing through, or parallel to, a rotation axis of the cylinder, while the respective longitudinal axes of the second hole and the third hole lie in opposite semi-spaces with respect to the vertical plane, so that are positioned in the body on opposite sides with respect to the first hole.

20. The device (1) of claim 10, wherein the closed structure of the frame defines a closed pathway crossing, in continuity, successive elements of the frame, or wherein the first column, the reinforcing element, the second column and the fixed ring of the bearing structure of the knitting machine realize overall a rigid quadrilateral solidly constrained to, and at least partially crossing, the body of the device.

* * * * *